US008672426B2

(12) United States Patent
Heo

(10) Patent No.: US 8,672,426 B2
(45) Date of Patent: Mar. 18, 2014

(54) CLOTHES TREATING APPARATUS WITH STACKING STRUCTURE

(75) Inventor: Namyeong Heo, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 196 days.

(21) Appl. No.: 13/076,648

(22) Filed: Mar. 31, 2011

(65) Prior Publication Data

US 2011/0241501 A1 Oct. 6, 2011

(30) Foreign Application Priority Data

Apr. 1, 2010 (KR) ..... 10-2010-0030118

(51) Int. Cl.
*F16B 12/00* (2006.01)

(52) U.S. Cl.
USPC ..... 312/111; 312/228

(58) Field of Classification Search
USPC ..... 312/228, 223.2, 111; 248/188.2, 188.4
See application file for complete search history.

(56) References Cited

U.S. PATENT DOCUMENTS

| | | | | |
|---|---|---|---|---|
| 3,436,045 | A * | 4/1969 | Anspaugh | 410/46 |
| 4,247,158 | A * | 1/1981 | Quayle | 312/213 |
| 4,510,778 | A * | 4/1985 | Cotton | 68/12.15 |
| 4,844,565 | A * | 7/1989 | Brafford et al. | 312/107.5 |
| 4,973,023 | A * | 11/1990 | O'Neill | 248/551 |
| 5,158,346 | A * | 10/1992 | Marks et al. | 312/204 |
| 5,613,747 | A * | 3/1997 | Becker et al. | 312/278 |
| 5,653,416 | A | 8/1997 | Frank | |
| 5,921,643 | A * | 7/1999 | Louth | 312/111 |
| 6,409,129 | B1 * | 6/2002 | Chen et al. | 248/188.8 |
| 6,427,966 | B1 * | 8/2002 | Blumenschein | 248/678 |
| 7,281,775 | B2 * | 10/2007 | Yang | 312/348.1 |
| 7,469,872 | B2 * | 12/2008 | Compagnone et al. | 248/639 |
| 8,266,930 | B2 * | 9/2012 | Jeong et al. | 68/27 |
| 2003/0010886 | A1 * | 1/2003 | Barnes et al. | 248/680 |
| 2004/0263032 | A1 * | 12/2004 | Cho | 312/330.1 |
| 2005/0071929 | A1 * | 4/2005 | Mani et al. | 8/158 |
| 2005/0139738 | A1 * | 6/2005 | Hwang et al. | 248/188.1 |
| 2005/0172678 | A1 * | 8/2005 | Kim et al. | 68/3 R |
| 2006/0103281 | A1 * | 5/2006 | Cho | 312/351.2 |
| 2007/0119216 | A1 * | 5/2007 | Jeong et al. | 68/3 R |
| 2007/0151120 | A1 * | 7/2007 | Tomasi et al. | 34/601 |
| 2008/0053159 | A1 * | 3/2008 | Hwang et al. | 68/12.01 |
| 2008/0053166 | A1 * | 3/2008 | Lim | 68/5 C |
| 2009/0057527 | A1 * | 3/2009 | Jo | 248/639 |
| 2009/0072684 | A1 * | 3/2009 | Woo et al. | 312/228 |
| 2009/0096331 | A1 * | 4/2009 | Park et al. | 312/107 |
| 2009/0146536 | A1 * | 6/2009 | Kim et al. | 312/228 |
| 2009/0153004 | A1 * | 6/2009 | Han et al. | 312/228 |
| 2011/0221313 | A1 * | 9/2011 | Stegerwald | 312/215 |

FOREIGN PATENT DOCUMENTS

KR 1020080032362 A * 4/2008

* cited by examiner

*Primary Examiner* — Hanh V Tran
(74) *Attorney, Agent, or Firm* — McKenna Long & Aldridge, LLP

(57) ABSTRACT

A clothes treating apparatus having a stacking structure. The clothes treating apparatus includes upper and lower clothes treating apparatuses each having a cabinet and legs installed below the cabinet, wherein leg accommodation portions for accommodating the legs of the upper clothes treating apparatus are formed on an upper surface of the cabinet of the lower clothes treating apparatus, and the upper and lower clothes treating apparatuses are fixed to each other as the legs are insertion-fixed to the leg accommodation portions.

10 Claims, 7 Drawing Sheets

CLOTHES TREATING APPARATUS WITH STACKING STRUCTURE

CROSS-REFERENCE TO RELATED APPLICATION

Pursuant to 35 U.S.C. §119(a), this application claims the benefit of earlier filing date and right of priority to Korean Application No. 10-2010-0030118, filed on Apr. 1, 2010, the contents of which is incorporated by reference herein in its entirety.

BACKGROUND OF THE INVENTION

1. Field of the Invention

This specification relates to a clothes treating apparatus with a stacking structure, and particularly, to a clothes treating apparatus with a stacking structure capable of stably stacking a plurality of clothes treating apparatuses on each other.

2. Discussion of the Related Art

A clothes treating apparatus such as a washing machine or a clothes dryer may be classified into various types according to a structure and an operation method. Especially, this clothes apparatus may be classified into a home clothes treating apparatus and a commercial clothes treating apparatus according to a usage purpose.

The home clothes treating apparatus is used by a small number of users who reside at home or a small area. On the other hand, the commercial clothes treating apparatus is used by a large number of users for a relatively longer time. Accordingly, this commercial clothes treating apparatus is required to have an enhanced reliability and endurance, and to have a facilitated structure for maintenance and repairs. Furthermore, a facility manager who manages a work site makes profits when maintenance costs are lowered. Accordingly, the commercial clothes treating apparatus has to have excellent energy efficiency.

For the facility manager's profits, a larger number of apparatuses have to be installed within a limited work site. For this, a plurality of clothes treating apparatuses are generally stacked on each other in a vertical direction.

FIG. 1 is a front view of a stack type of commercial clothes treating apparatus in accordance with the conventional art. As shown in FIG. 1, the clothes treating apparatus is implemented as an upper clothes treating apparatus 10 and a lower clothes treating apparatus 20 separately manufactured from each other are fixed to each other in a stacked manner in the work site. This fixing operation is performed by an installation engineer on the spot with using an additional fixing device, such that the upper clothes treating apparatus can be stably fixed to the lower clothes treating apparatus.

As shown in FIG. 1, there is a gap between the two clothes treating apparatuses due to legs positioned on a bottom surface of the upper clothes treating apparatus 10. This gap may cause a third person to easily access the fixing device, resulting in a high possibility that a coin box installed in the clothes treating apparatus may be stolen.

To prevent this, required is an additional member for blocking the gap. However, in this case, installation costs may be increased and installation processes may become complicated.

SUMMARY OF THE INVENTION

Therefore, an aspect of the detailed description is to provide a clothes treating apparatus with a stacking structure capable of fixing upper and lower clothes treating apparatuses vertically stacked on each other, to each other without a gap therebetween.

To achieve these and other advantages and in accordance with the purpose of this specification, as embodied and broadly described herein, there is provided a clothes treating apparatus including upper and lower clothes treating apparatuses each having a cabinet and legs installed below the cabinet, wherein leg accommodation portions for accommodating the legs of the upper clothes treating apparatus are formed on an upper surface of the cabinet of the lower clothes treating apparatus, and the upper and lower clothes treating apparatuses are fixed to each other as the legs are insertion-fixed to the leg accommodation portions.

As the upper clothes treating apparatus may be fixed to the lower clothes treating apparatus with an accommodated state in the leg accommodation portions formed on an upper surface of the lower clothes treating apparatus, the two clothes treating apparatuses may be stacked on each other with a minimized gap or no gap therebetween. This may enhance security.

The upper and lower clothes treating apparatuses may be the same type or different types from each other. For instance, the upper clothes treating apparatus may be implemented as a clothes dryer and the lower clothes treating apparatus may be implemented as a washing machine. Alternatively, both of the upper and lower clothes treating apparatuses may be clothes driers or washing machines.

The leg accommodation portions may be penetratingly formed on an upper surface of the cabinet. Alternatively, the leg accommodation portions may be concavely formed on a surface of the cabinet. The leg may include a screw portion screw-coupled to a bottom surface of the cabinet in a penetrating manner, and a support portion fixed to an end of the screw portion and having a diameter larger than that of the screw portion.

Each of the leg accommodation portions may include a first accommodation portion having a shape to pass the support portion therethrough, and a second accommodation portion connected to the first accommodation portion and configured to pass only the screw portion therethrough, not the support portion. Under this configuration, the leg may be inserted into the first accommodation portion, and then the upper clothes treating apparatus may be slid to insert the leg into the second accommodation portion. This may allow the upper and lower clothes treating apparatuses to be fixed to each other.

A part of the screw portion may be protruding to inside of the cabinet through a bottom surface of the cabinet of the upper clothes treating apparatus. A service hole for accessing the protruding part by an installation engineer and so on may be formed on the upper clothes treating apparatus.

The service hole may be formed at any position of the cabinet. For instance, the service hole may be formed at a lower part of a front surface of the upper clothes treating apparatus. In this case, a manipulation panel for manipulating the upper clothes treating apparatus may be detachably mounted to a front surface of the service hole. This may allow two manipulation panels positioned at upper and lower sides to be adjacent to each other, and thus enhance a user's manipulation characteristic.

A fixing nut may be additionally coupled to the screw portion which is accessible through the service hole, thereby more firmly fixing the upper and lower clothes treating apparatuses to each other. Supplementary fixing means fixed to the upper and lower clothes treating apparatuses may be further included. The supplementary fixing means may be implemented as a fixing plate extending between the upper and lower clothes treating apparatuses.

According to another aspect of the present invention, there is provided a clothes treating apparatus including a cabinet and legs installed below the cabinet, wherein each of the legs includes a screw portion screw-coupled to a bottom surface of the cabinet in a penetrating manner, and a support portion fixed to an end of the screw portion and having a diameter larger than that of the screw portion. A service hole for accessing the screw portion protruding into the cabinet may be formed at the cabinet.

The service hole may be formed at a lower part of a front surface of the cabinet, and a manipulation panel for manipulating the clothes treating apparatus may be detachably mounted to a front surface of the service hole.

A fixing nut coupled to the screw portion protruding into the cabinet may be further included.

According to still another aspect of the present invention, there is provided a clothes treating apparatus including a cabinet and legs installed below the cabinet, wherein leg accommodation portions for accommodating legs of a clothes treating apparatus to be stacked on an upper surface of the cabinet are formed on the upper surface of the cabinet.

The leg accommodation portions may be penetratingly formed or concavely formed on an upper surface of the cabinet.

Each of the leg accommodation portions may include a first accommodation portion having a shape to pass the leg therethrough, and a second accommodation portion connected to the first accommodation portion and having a width wide enough to prevent separation of the inserted leg.

As the upper clothes treating apparatus may be fixed to the lower clothes treating apparatus with an accommodated state in the leg accommodation portions formed on an upper surface of the lower clothes treating apparatus, the two clothes treating apparatuses may be stacked on each other with a minimized gap or no gap therebetween. This may enhance security.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE ILLUSTRATED EMBODIMENTS

Description will now be given in detail of the exemplary embodiments, with reference to the accompanying drawings. For the sake of brief description with reference to the drawings, the same or equivalent components will be provided with the same reference numbers, and description thereof will not be repeated.

Hereinafter, a preferred embodiment of a clothes treating apparatus with a stacking structure according to the present invention will be explained in more details with reference to the attached drawings.

Figure 1:
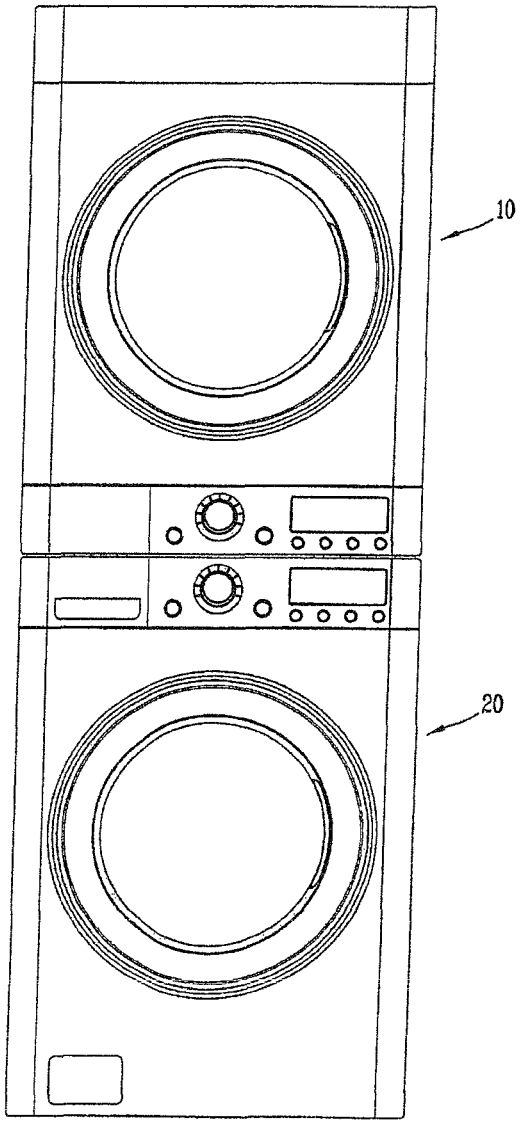
FIG. 1 is a front view of a stack type of commercial clothes treating apparatus in accordance with the conventional art.
Figure 2:
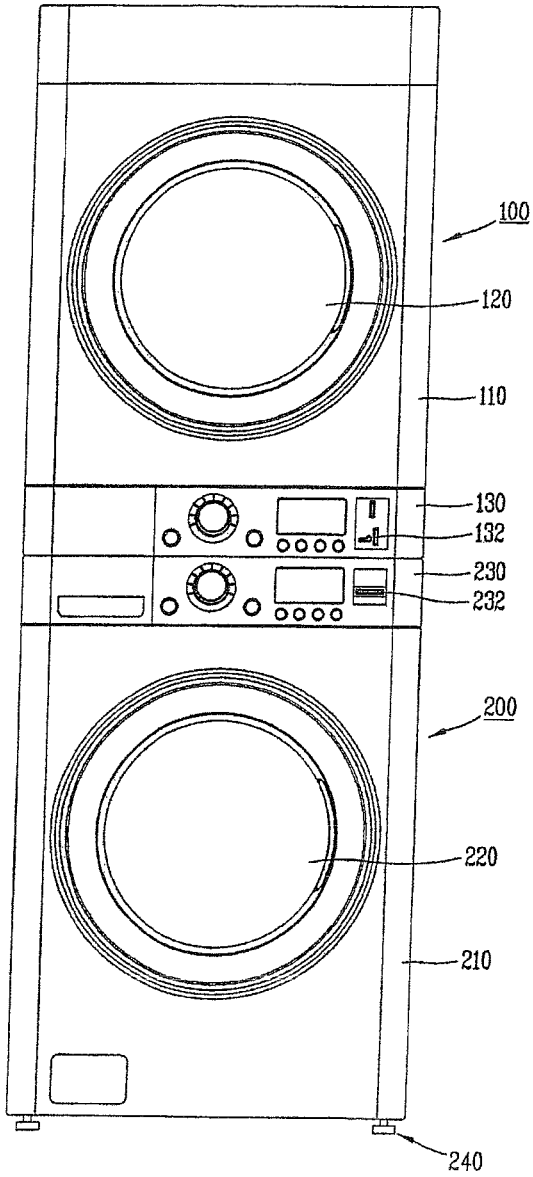
FIG. 2 is a front view of a clothes treating apparatus with a stacking structure according to a first embodiment of the present invention.

FIG. 2 is a front view of a clothes treating apparatus with a stacking structure according to a first embodiment of the present invention. The clothes treating apparatus comprises an upper clothes treating apparatus 100, and a lower clothes treating apparatus 200 positioned below the upper clothes treating apparatus 100. The upper and lower clothes treating apparatuses may be the same type or different types from each other. For instance, both of the upper and lower clothes treating apparatuses may be clothes driers or washing machines. Alternatively, one of the upper and lower clothes treating apparatuses may be a clothes dryer, and another of the upper and lower clothes treating apparatuses may be a washing machine.

The upper and lower clothes treating apparatuses include cabinets 110 and 210 which form the appearance thereof, respectively. Doors 120 and 220 are installed on front surfaces of the cabinets 110 and 210, through which laundry is introduced into drums installed in the cabinets 110 and 210.

Manipulation panels 130 and 230 for manipulating the upper and lower clothes treating apparatuses are positioned on front surfaces of the cabinets 110 and 210. The manipulation panel 130 of the upper clothes treating apparatus 100 is positioned at a lower part of a front surface of the cabinet 110, whereas the manipulation panel 230 of the lower clothes treating apparatus 200 is positioned at an upper part of a front surface of the cabinet 210. The two manipulation panels are adjacent to each other, and are positioned at heights to which a user is easily accessible. This may enhance a user's manipulation characteristics.

A coin box 132 and a card reader 232 are installed at the manipulation panels 130 and 230, respectively. Here, the coin box 132 and the card reader 232 may be integrally formed with each other so that only inlets thereof may be positioned at the manipulation panels.

Legs 140 and 240 for stably supporting the cabinets on a bottom surface of an installation spot are installed on bottom surfaces of the cabinets 110 and 210, respectively. In FIG. 2, the legs 140 of the upper clothes treating apparatus 100 are not shown since they are in an inserted state into an upper surface of the cabinet 210 of the lower clothes treating apparatus. The clothes treating apparatus is fixed in a state that a bottom surface of the cabinet 110 of the upper clothes treating apparatus and an upper surface of the cabinet 210 of the lower clothes treating apparatus come in contact with each other. As a result, there occurs no gap between the upper and lower clothes treating apparatuses.

The legs of the upper clothes treating apparatus may also serve as fixing means for fixing the upper and lower clothes treating apparatuses to each other. The legs 140, fixing means are not exposed to the outside due to no gap between the upper and lower clothes treating apparatuses. This may prevent a third person from easily separating the upper and lower clothes treating apparatuses from each other. As a result, security may be enhanced.

Figure 3:
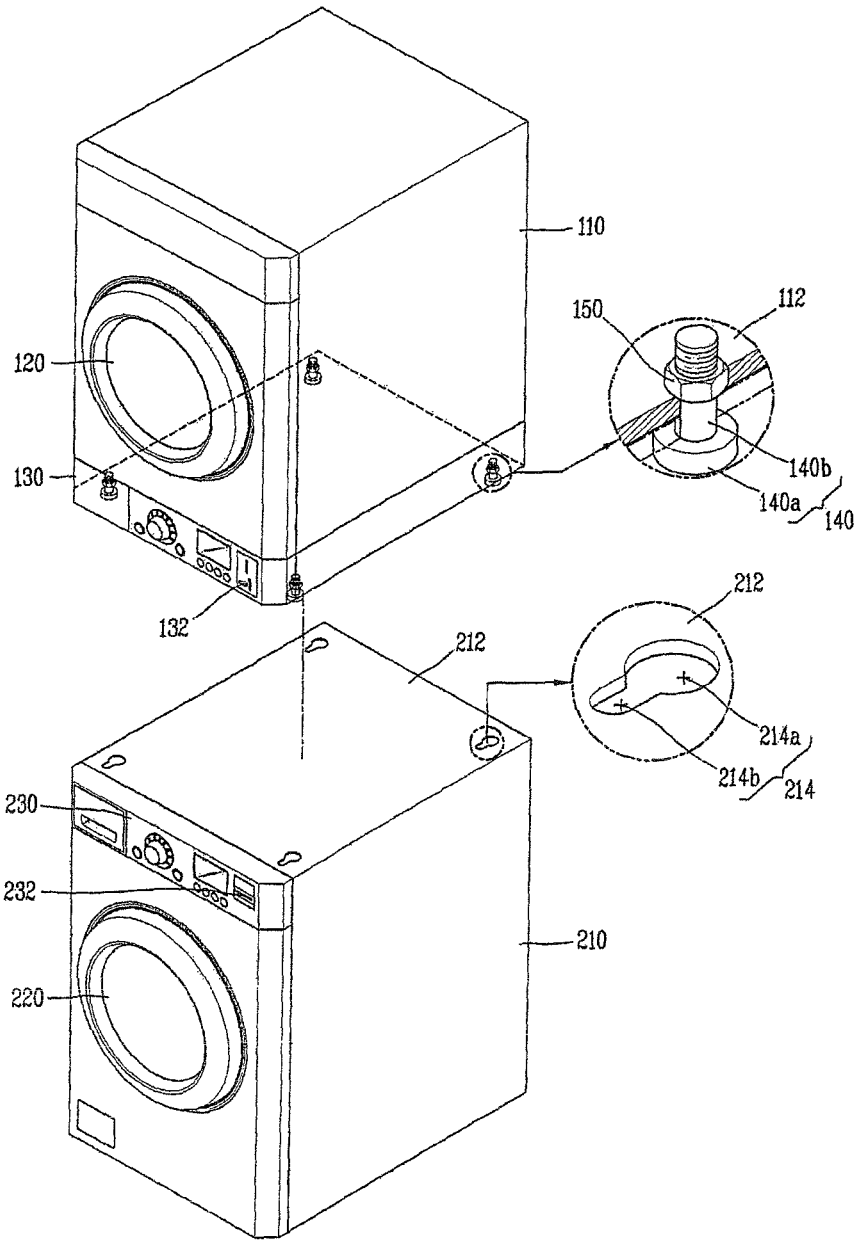
FIG. 3 is a disassembled perspective view showing a coupled structure between upper and lower clothes treating apparatus of FIG. 2.

FIG. 3 is a disassembled perspective view showing a coupled structure between the upper and lower clothes treating apparatuses. Referring to FIG. 3, leg insertion holes 214 are formed at corners of an upper surface 212 of the cabinet 210 of the lower clothes treating apparatus. The leg insertion holes 214 are configured to insert the legs 140 of the upper clothes treating apparatus thereinto.

Each of the legs 140 includes a support portion 140*a* directly contacting a bottom surface and supporting the cabinet 110, and a screw portion 140*b* connected to the support portion 140*a* and penetratingly-inserted into a bottom surface of the cabinet 110. The support portion 140*a* is formed in a disc shape having a diameter larger than that of the screw portion 140*b*. The screw portion 140*b* is formed in a cylindrical shape having a screw thread on an outer circumference surface thereof. One end of the screw portion 140*b* of the screw portion 140*b* is protruding to inside of the cabinet 110 of the upper clothes treating apparatus by penetrating a bottom surface of the cabinet 110.

The leg insertion holes 214 consist of two holes having different widths. One is a first insertion hole 214*a* having a diameter larger than that of the support portion 140*a* and configured to easily pass the support portion 140*a* therethrough, and another is a second insertion hole 214*b* having a diameter smaller than that of the support portion 140*a* but larger than that of the screw portion 140*b*. Under this configuration, the leg 140 cannot pass through the second insertion hole 214*b*, but can pass through only the first insertion hole 214*a*.

Figure 4:
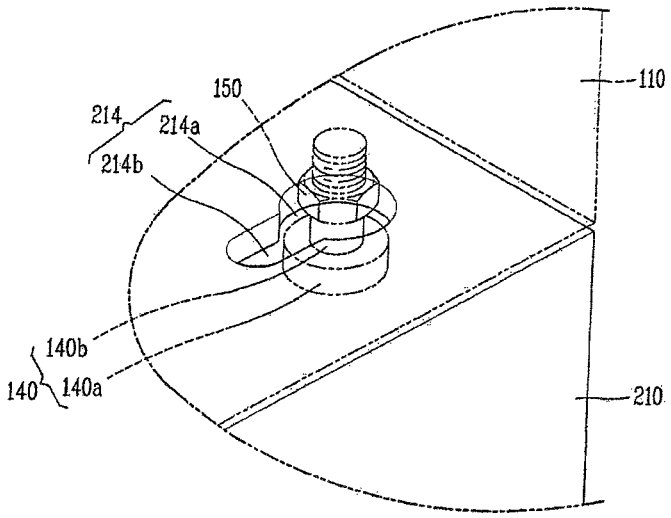
FIGS. 4 and 5 are perspective views showing processes for coupling an upper clothes treating apparatus to a lower clothes treating apparatus of FIG. 2.
Figure 5:
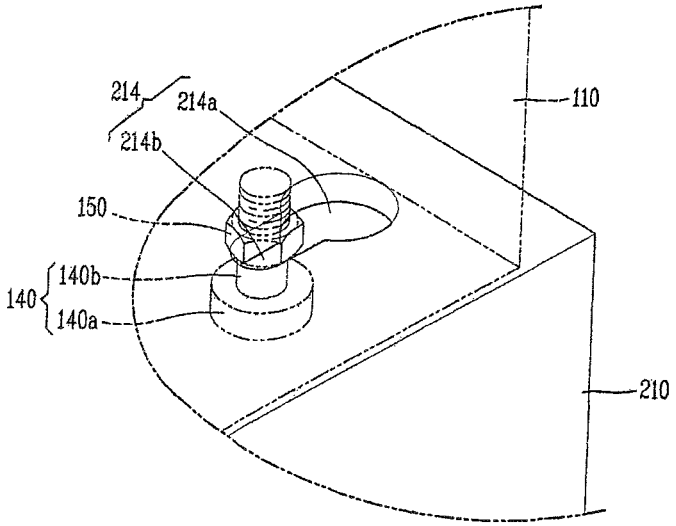

As shown in FIGS. 4 and 5, in order to fix the upper clothes treating apparatus to the lower clothes treating apparatus, the two clothes treating apparatuses have to be aligned so that the support portion 140*a* can be positioned above the first insertion hole 214*a*. Then, the support portion 140*a* is inserted into the first insertion hole 214*a*. Then, the upper clothes treating apparatus 100 is forwardly slid, thereby locating the support portion 140*a* on a bottom surface of the second insertion hole 214*b*.

In this state, the support portion 140*a* cannot pass through the second insertion hole 214*b*. Accordingly, the two clothes treating apparatuses maintain a fixed state unless the support portion 140*a* moves toward the first insertion hole 214*a*.

Figure 6:
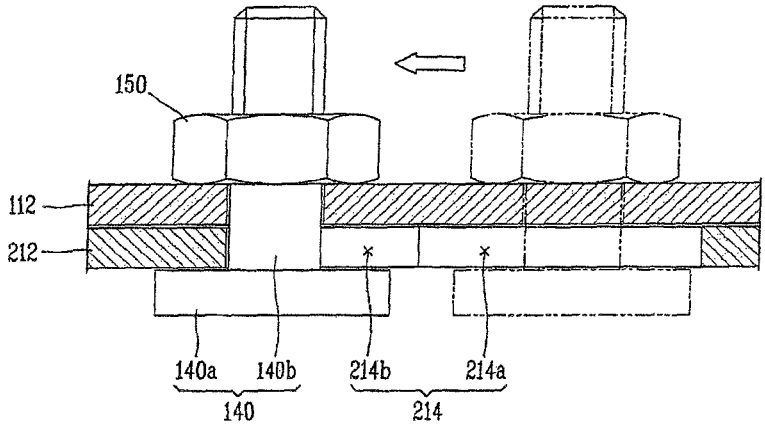
FIG. 6 is a sectional view showing a coupled state between an upper clothes treating apparatus and a lower clothes treating apparatus of FIG. 2.

In a state that the support portion 140*a* is located on a bottom surface of the second insertion hole 214*b*, a fixing nut 150 is coupled to the screw portion 140*b* thereby to fix the upper and lower clothes treating apparatuses to each other more firmly. As shown in FIG. 6, once the fixing nut 150 is coupled to the screw portion 140*b*, a bottom surface 112 of the cabinet of the upper clothes treating apparatus and an upper surface 212 of the cabinet of the lower clothes treating apparatus are in a compressed state. Accordingly, the upper clothes treating apparatus is not backwardly slid.

The screw portion 140*b* is positioned in the cabinet 10 of the upper clothes treating apparatus, thereby not being separated from the cabinet 110 from outside. This may enhance security. However, in order to couple the fixing nut 150 to the screw portion 140*b*, access to the screw portion 140*b* from outside has to be implemented.

Figure 7:
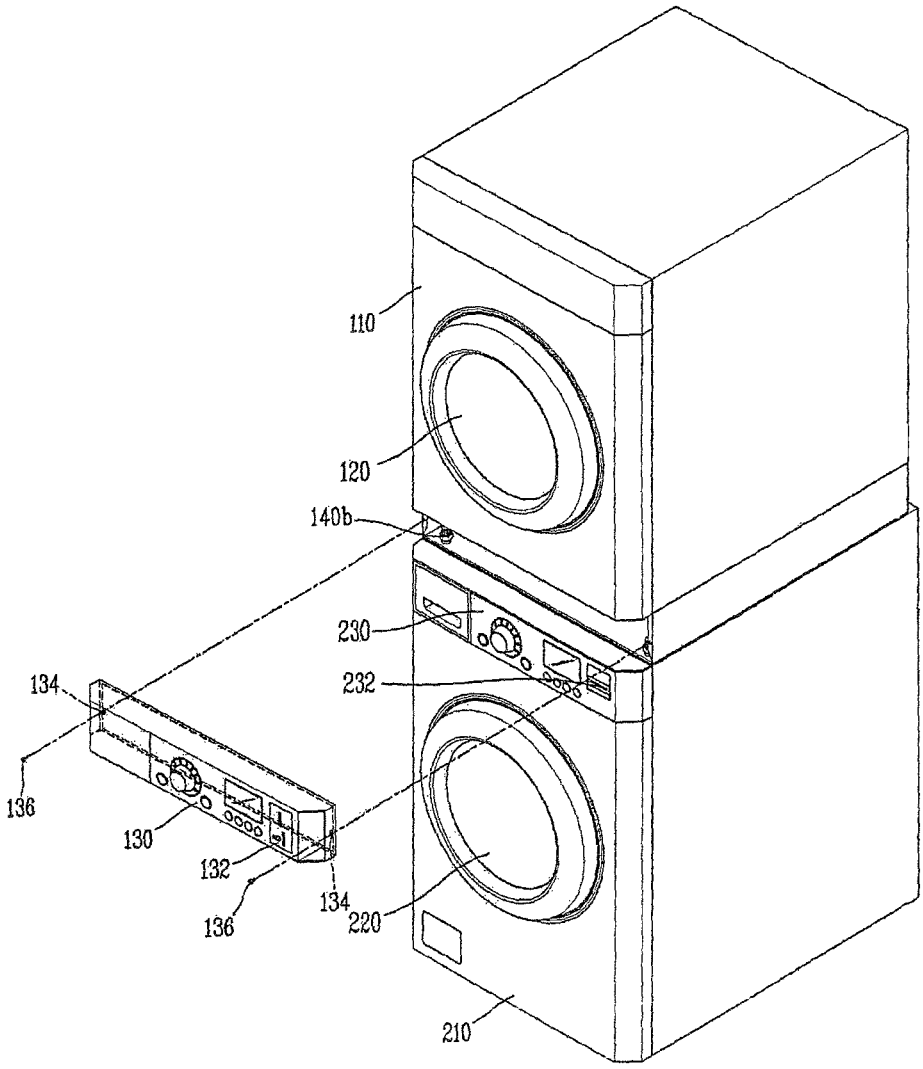
FIG. 7 is an enlarged perspective view showing a coupled state between an upper clothes treating apparatus and a lower clothes treating apparatus of FIG. 2.

To this end, as shown in FIG. 7, a service hole 114 is formed at a lower part of a front surface of the cabinet 110 of the upper clothes treating apparatus. Access to inside of the bottom surface 112 of the upper clothes treating apparatus is possible, thereby coupling the fixing nut 150 to the screw portion 140*b*.

The service hole 114 may not be necessarily formed on the front surface of the cabinet, but may be formed on a side surface or a rear surface. As shown in FIG. 7, for an enhanced design, the service hole 114 may be formed on the front surface of the cabinet, and the manipulation panel 130 may be detachably mounted to a front surface of the service hole 114. In this case, the service hole 114 may also serve as a passage through which a cable passes, the cable for connecting the manipulation panel 130 to a controller (not shown) inside the clothes treating apparatus.

Bolt coupling portions 134 are formed at two ends of the manipulation panel 130. Fixing bolts 136 may be coupled to the bolt coupling portions 134, thereby fixing the manipulation panel 130 to the cabinet 110. To the contrary, the fixing bolts 136 may be separated from the bolt coupling portions 134, thereby separating the manipulation panel 130 from the cabinet 110.

Figure 8:
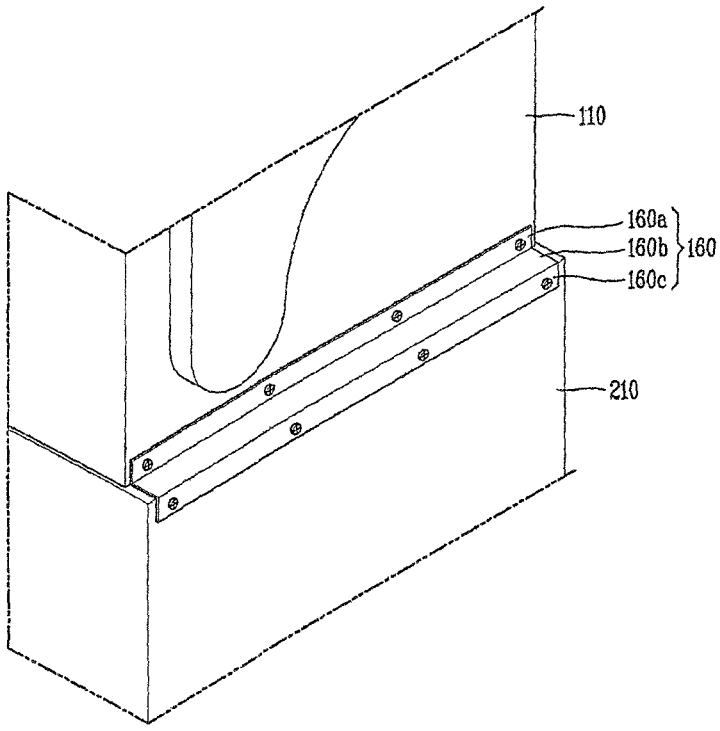
FIG. 8 is a perspective view showing a rear surface of the apparatus of FIG. 2.

Supplementary fixing means rather than the fixing nut may be additionally included. FIG. 8 shows the clothes treating apparatus having the supplementary fixing means applied thereto. Referring to FIG. 8, a fixing plate 160 serving as the supplementary fixing means is installed between a rear surface of the cabinet 110 of the upper clothes treating apparatus and a rear surface of the cabinet 210 of the lower clothes treating apparatus.

The fixing plate 160 includes a first plate 160*a* fixed to a rear surface of the cabinet 110 of the upper clothes treating apparatus by bolts, and the like, a second plate 160*b* covering a part of an upper surface of the cabinet 210 of the lower clothes treating apparatus, and a third plate 160*c* fixed to a rear surface of the cabinet 210 of the lower clothes treating apparatus by bolts, and the like. Each of the first to third plates is bent so as to be closely adhered to the cabinets 110 and 210.

The fixing nut 150 and the fixing plate 160 serve to fix the upper and lower clothes treating apparatuses more firmly by preventing the upper clothes treating apparatus from being backwardly slid.

When the upper and lower clothes treating apparatuses have the same size, the second plate 160*b* may be omitted.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A clothes treating apparatus, comprising:

an upper clothes treating apparatus; and a lower clothes treating apparatus, wherein each of the upper and lower clothes treating apparatuses comprises a cabinet;

a door installed on a front surface of the cabinet;

a manipulation panel; and a plurality of legs installed below the cabinet, wherein the lower clothes treating apparatus further comprises a plurality of leg accommodation portions formed on an upper surface of the cabinet of the lower clothes treating apparatus to accommodate the plurality of legs of the upper clothes treating apparatus, wherein the cabinet of upper clothes treating apparatus further comprises a service hole for accessing inside thereof in its lower side and for serving as a passage through which a cable passes, the cable for electrically connecting the manipulation panel of the upper clothes treating apparatus to a controller inside the cabinet of the upper clothes treating apparatus, wherein the manipulation panel of the upper clothes treating apparatus for manipulating the upper clothes treating apparatus is detachably mounted to the cabinet to close the service hole, and wherein the upper and lower clothes treating apparatuses are fixed to each other as the plurality of legs of the upper clothes treating apparatus are insertion-fixed to the plurality of leg accommodation portions of the lower clothes treating apparatus.

2. The clothes treating apparatus of claim 1, wherein the plurality of leg accommodation portions are penetratingly formed on the upper surface of the cabinet of the lower clothes treating apparatus.

3. The clothes treating apparatus of claim 2, wherein each of the plurality of legs comprises:

a screw portion having a first diameter coupled to a bottom surface of the cabinet in a penetrating manner; and a support portion having a second diameter larger than the first diameter fixed to an end of the screw portion.

4. The clothes treating apparatus of claim 3, wherein each of the plurality of leg accommodation portions comprises:

a first accommodation portion having a shape to pass the support portion therethrough; and a second accommodation portion connected to the first accommodation portion to pass only the screw portion therethrough.

5. The clothes treating apparatus of claim 3, wherein the service hole enables access to the screw portion.

6. The clothes treating apparatus of claim 5, further comprising:

a fixing nut coupled to the screw portion penetrating inside the cabinet.

7. The clothes treating apparatus of claim 1, further comprising:

a supplementary fixing member fixed to the upper and lower clothes treating apparatuses when the upper and lower clothes treating apparatuses have been coupled to each other.

8. The clothes treating apparatus of claim 7, wherein the supplementary fixing member includes fixing plates extending between the upper and lower clothes treating apparatuses.

9. A clothes treating apparatus, comprising:

a cabinet;

a door installed on a front surface of the cabinet;

a manipulation panel for manipulating the clothes treating apparatus;

a controller disposed inside the cabinet;

a cable for electrically connecting the manipulation panel to the controller; and a plurality of legs installed below the cabinet, wherein each of the plurality of legs comprises a screw portion having a first diameter coupled to a bottom surface of the cabinet in a penetrating manner, and a support portion fixed to an end of the screw portion and having a second diameter larger than the first diameter, and wherein a service hole for accessing the screw portion penetrating into the cabinet and for serving as a passage through which the cable passes is formed in a lower side of the cabinet, and wherein the manipulation panel is detachably mounted to the cabinet to close the service hole.

10. The clothes treating apparatus of claim 9, further comprising:

a fixing nut coupled to the screw portion penetrating into the cabinet.

* * * * *